US010220237B2

(12) United States Patent
Bentley

(10) Patent No.: US 10,220,237 B2
(45) Date of Patent: Mar. 5, 2019

(54) EXERCISE TRAINING DEVICE

(71) Applicant: LeCharles Bentley, Gilbert, AZ (US)

(72) Inventor: LeCharles Bentley, Gilbert, AZ (US)

(73) Assignee: LeCharles Bentley, Gilbert, AZ (US)

( * ) Notice: Subject to any disclaimer, the term of this patent is extended or adjusted under 35 U.S.C. 154(b) by 173 days.

(21) Appl. No.: 15/275,326

(22) Filed: Sep. 23, 2016

(65) Prior Publication Data

US 2017/0080272 A1 Mar. 23, 2017

Related U.S. Application Data

(60) Provisional application No. 62/222,318, filed on Sep. 23, 2015.

(51) Int. Cl.

| | |
|---|---|
| ***A63B 21/045*** | (2006.01) |
| ***A63B 21/00*** | (2006.01) |
| ***A63B 21/02*** | (2006.01) |
| *A63B 23/12* | (2006.01) |
| *A63B 23/14* | (2006.01) |

(52) U.S. Cl.

CPC ..... *A63B 21/045* (2013.01); *A63B 21/0004* (2013.01); *A63B 21/00043* (2013.01); *A63B 21/023* (2013.01); *A63B 21/4035* (2015.10); *A63B 23/1272* (2013.01); *A63B 23/14* (2013.01); *A63B 2225/09* (2013.01)

(58) Field of Classification Search

CPC ..... A63B 21/045; A63B 21/00043; A63B 21/023; A63B 21/4035; A63B 21/0004; A63B 23/1272; A63B 23/14; A63B 2225/09

USPC ..... 482/121–126

See application file for complete search history.

(56) References Cited

U.S. PATENT DOCUMENTS

| | | | | | |
|---|---|---|---|---|---|
| 3,396,967 | A * | 8/1968 | Brown | A63B 21/0455 | 482/128 |
| 3,451,675 | A * | 6/1969 | Burzenski | A63B 21/00043 | 403/229 |
| 3,761,083 | A * | 9/1973 | Buchner | A63B 21/05 | 482/126 |
| 4,489,937 | A * | 12/1984 | Kong | A63B 21/00043 | 482/126 |
| 4,651,985 | A * | 3/1987 | Salisbury | A63B 21/00043 | 482/122 |
| 4,856,776 | A * | 8/1989 | Ching-Liang | A63B 21/045 | 482/122 |

(Continued)

*Primary Examiner* — Andrew S Lo

(74) *Attorney, Agent, or Firm* — Cooper Legal Group, LLC

(57) ABSTRACT

An exercise training device includes a housing portion extending between a first end and a second end. The housing portion defines an internal bore. A biasing device is disposed within the internal bore. A first gripping portion is received within the internal bore through the first end of the housing portion. The first gripping portion is attached to a first biasing end of the biasing device. The first gripping portion is gripped by a user. A second gripping portion is received within the internal bore through the second end of the housing portion. The second gripping portion is attached to a second biasing end of the biasing device. The second gripping portion is gripped by the user. In response to a pressure applied, the biasing device and the housing portion are movable from an unflexed position to a flexed position.

18 Claims, 4 Drawing Sheets

(56) References Cited

U.S. PATENT DOCUMENTS 5,022,648 A * 6/1991 Travis ..... A63B 21/00043 482/122
5,569,137 A * 10/1996 Uen ..... A63B 21/0004 482/121
6,022,302 A * 2/2000 McBride ..... A63B 21/00043 482/121
6,371,465 B1 * 4/2002 Willis ..... F16F 1/06 267/166
6,390,959 B1 * 5/2002 Tornabene ..... A63B 21/00043 482/122
6,648,804 B2 * 11/2003 Chen ..... A63B 21/0004 482/125
6,752,747 B2 * 6/2004 Yu ..... A63B 21/00043 482/110
6,857,994 B2 * 2/2005 Yu ..... A63B 21/0004 482/121
8,485,949 B2 * 7/2013 Hsu ..... A63B 21/027 482/110
D700,741 S * 3/2014 Fallah ..... D28/44.1
8,777,821 B2 * 7/2014 Lando ..... A63B 21/023 482/121
2004/0132592 A1 * 7/2004 Yu ..... A63B 21/0004 482/126
2005/0233877 A1 * 10/2005 Lin ..... A63B 21/00043 482/126
2008/0051271 A1 * 2/2008 Mandell ..... A63B 21/00043 482/122
2008/0064536 A1 * 3/2008 Battaglino ..... A63B 59/00 473/457
2010/0009822 A1 * 1/2010 Holleman ..... A63B 21/0004 482/126
2010/0179037 A1 * 7/2010 Reilly ..... A63B 15/00 482/139
2010/0240505 A1 * 9/2010 Yang ..... A63B 21/0004 482/126
2011/0201483 A1 * 8/2011 Holleman ..... A63B 21/0004 482/122
2013/0029811 A1 * 1/2013 Lando ..... A63B 21/023 482/121
2013/0196830 A1 * 8/2013 Pfitzer ..... A63B 21/0602 482/110
2014/0221173 A1 * 8/2014 Crabtree ..... A63B 21/0724 482/106
2015/0018132 A1 * 1/2015 Lovelace ..... A63B 69/0002 473/458
2016/0030797 A1 * 2/2016 Erickson ..... A63B 21/068 482/132
2016/0038793 A1 * 2/2016 Kikel ..... A63B 43/04 310/38

* cited by examiner

100

EXERCISE TRAINING DEVICE

CROSS-REFERENCE TO RELATED APPLICATIONS

This application claims priority to U.S. Provisional Patent Application No. 62/222,318, filed on Sep. 23, 2015, the entire disclosure of which is hereby incorporated by reference.

TECHNICAL FIELD

The instant application is generally directed towards an exercise training device. For example, the instant application is directed towards an exercise training device for assisting an athlete with proper hand positioning.

BACKGROUND

Exercise training devices may be used to help athletes. Such devices may be used, for example, to help athletes train in a variety of different sports.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

In an example, an exercise training device is provided comprising a housing portion extending between a first end and a second end along an axis. The housing portion has a housing wall defining an internal bore. The exercise training device comprises a biasing device disposed within the internal bore of the housing portion. The biasing device and the housing portion extend co-axially. The exercise training device comprises a first gripping portion received within the internal bore through the first end of the housing portion. The first gripping portion is attached to a first biasing end of the biasing device. The first gripping portion is configured to be gripped by a user. A second gripping portion is received within the internal bore through the second end of the housing portion. The second gripping portion is attached to a second biasing end of the biasing device. The second gripping portion is configured to be gripped by the user. In response to a pressure applied by the first gripping portion and the second gripping portion along a direction that is non-parallel to the axis, the biasing device and the housing portion are configured to move from an unflexed position, in which the biasing device and the housing portion extend along the axis, to a flexed position, in which the biasing device and the housing portion extend along a non-linear axis.

In another example, an exercise training device is provided comprising a biasing device extending between a first biasing end and a second biasing end along an axis. A first gripping portion is attached to the first biasing end of the biasing device. The first gripping portion is configured to be gripped by a user. A second gripping portion is attached to the second biasing end of the biasing device. The second gripping portion is configured to be gripped by the user. In response to a pressure applied by the first gripping portion and the second gripping portion along a direction that is non-parallel to the axis, the biasing device is configured to move from an unflexed position, in which the biasing device extends along the axis, to a flexed position, in which the biasing device extends along a non-linear axis.

In another example, an exercise training device is provided comprising a housing portion extending between a first end and a second end along an axis. The housing portion has a housing wall defining an internal bore. A biasing device is disposed within the internal bore of the housing portion. The biasing device and the housing portion extend co-axially. The biasing device has a biasing spring defining a second internal bore. A first gripping portion comprises a first attachment part received within the second internal bore through the first end of the housing portion and a first biasing end of the biasing device. The first attachment part engages the first biasing end to attach the first gripping portion to the biasing device. A first gripping part is attached to the first attachment part and extends at an exterior of the internal bore and the second internal bore. The first gripping part has a gripping surface that is configured to be gripped by a user. A second gripping portion comprises a second attachment part received within the second internal bore through the second end of the housing portion and a second biasing end of the biasing device. The second attachment part engages the second biasing end to attach the second gripping portion to the biasing device. A second gripping part is attached to the second attachment part and extends at an exterior of the internal bore and the second internal bore. The second gripping part has a second gripping surface that is configured to be gripped by a user. In response to a pressure applied by the first gripping portion and the second gripping portion along a direction that is non-parallel to the axis, the biasing device and the housing portion are configured to move from an unflexed position, in which the biasing device and the housing portion extend along the axis, to a flexed position, in which the biasing device and the housing portion extend along a non-linear axis.

The following description and annexed drawings set forth certain illustrative aspects and implementations. These are indicative of but a few of the various ways in which one or more aspects may be employed. Other aspects, advantages, and/or novel features of the disclosure will become apparent from the following detailed description when considered in conjunction with the annexed drawings.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
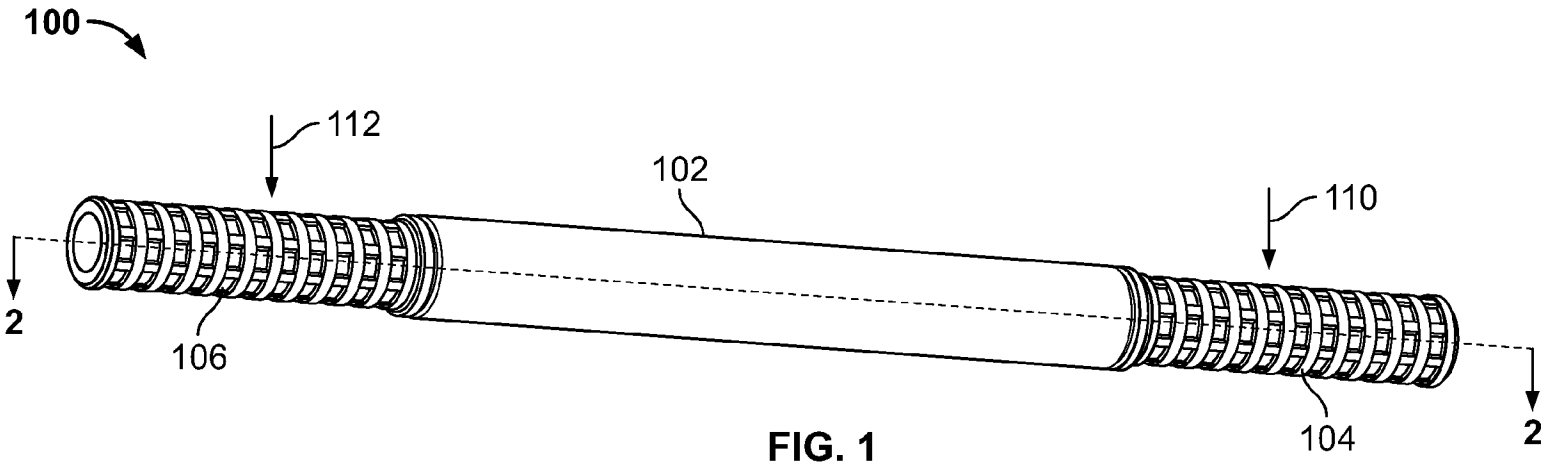
FIG. 1 is an illustration of an example training device in an unflexed position.

The following disclosure provides many different embodiments, or examples, for implementing different features of the provided subject matter. Specific examples of components and arrangements are described below to simplify the present disclosure. These are, of course, merely examples and are not intended to be limiting. For example, the attachment of a first feature and a second feature in the description that follows may include embodiments in which the first feature and the second feature are attached in direct contact, and may also include embodiments in which additional features may be positioned between the first feature and the second feature, such that the first feature and the second feature may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Referring to FIG. 1, an exercise training device 100 is provided. The exercise training device 100 may be provided for athletic training in a variety of sports. In an example, the exercise training device 100 may be used for football training, such as assisting offensive lineman in increasing muscle strength, hand eye coordination, hand quickness, blocking techniques, hand placement, etc.

The exercise training device 100 comprises a housing portion 102, a first gripping portion 104, and a second gripping portion 106. The housing portion 102 may extend between the first gripping portion 104 and the second gripping portion 106. In an example, the housing portion 102, the first gripping portion 104, and the second gripping portion 106 may extend substantially co-axially along a common axis. As will be explained herein, the housing portion 102 comprises a flexible and non-rigid material, such that the housing portion 102 is not limited to extending linearly along an axis. Rather, a user may grip the first gripping portion 104 and the second gripping portion 106 and apply a pressure 110, 112, so as to cause the housing portion 102 to bend, flex, and extend non-linearly.

Figure 2A:
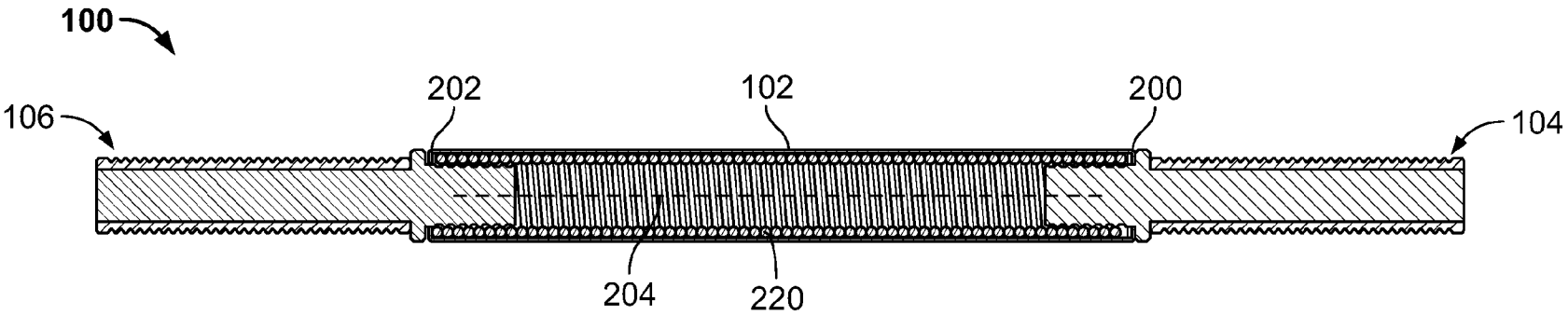
FIG. 2A is a sectional illustration of an example training device in an unflexed position.
Figure 2B:
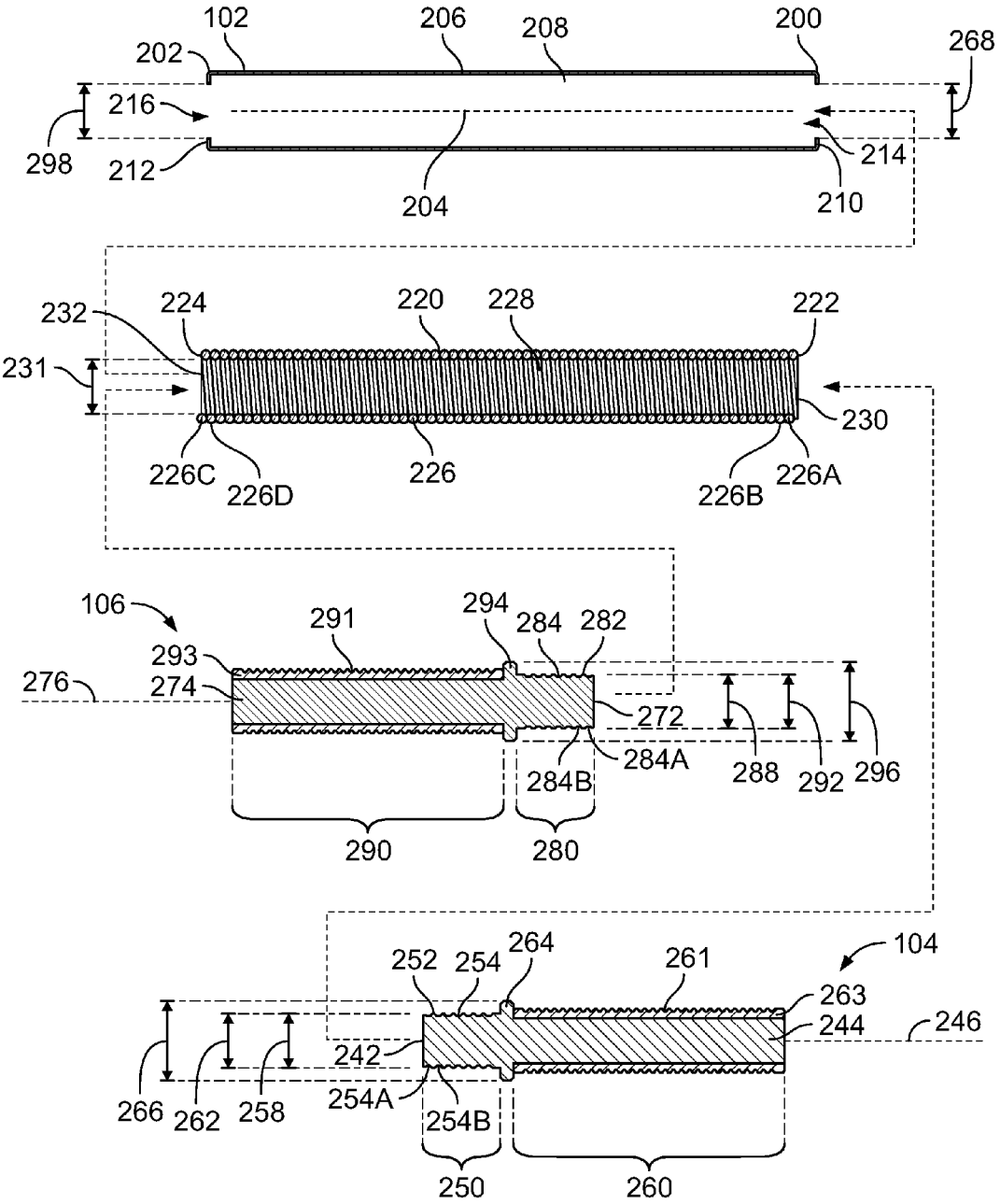
FIG. 2B is an illustration of an example training device.

Referring to FIGS. 2A and 2B, a sectional view of the exercise training device 100 as viewed from the perspective indicated by 2-2 of FIG. 1 is illustrated. FIG. 2A illustrates a sectional view of the exercise training device 100 in an assembled state similar to the example of FIG. 1. FIG. 2B illustrates a sectional view of the exercise training device 100 in an exploded state for the purposes of illustration. In an example, the exercise training device 100 is illustrated in an unflexed position. As will be described with respect to FIG. 5, the exercise training device 100 may also be moved to a flexed position.

The housing portion 102 may extend between a first end 200 and a second end 202 along an axis 204. In an example, the housing portion 102 may be substantially hollow, and may comprise a housing wall 206 that defines an internal bore 208. In an example, the housing portion 102 may have a substantially circular cross-sectional shape, though other shapes are envisioned (e.g., oval shape, quadrilateral shape, etc.). An inner radial surface and an outer radial surface of the housing wall 206 may be substantially flat and devoid of bumps, protrusions, extensions, etc.

The housing portion 102 may comprise a first end wall 210 and a second end wall 212. The first end wall 210 may be located at the first end 200 of the housing portion 102, while the second end wall 212 may be located at the second end 202 of the housing portion 102. The first end wall 210 may extend radially from an end of the housing wall 206 towards a center of the housing portion 102. In an example, the first end wall 210 may extend circumferentially around the first end 200 of the housing wall 206 to define a first end opening 214. The first end opening 214 may be in communication with the internal bore 208, such that one or more structures may pass between the internal bore and an exterior through the first end opening 214. In an example, the first end wall 210 may extend along a plane that is substantially perpendicular to the axis 204 and to the housing wall 206.

Figure 5:
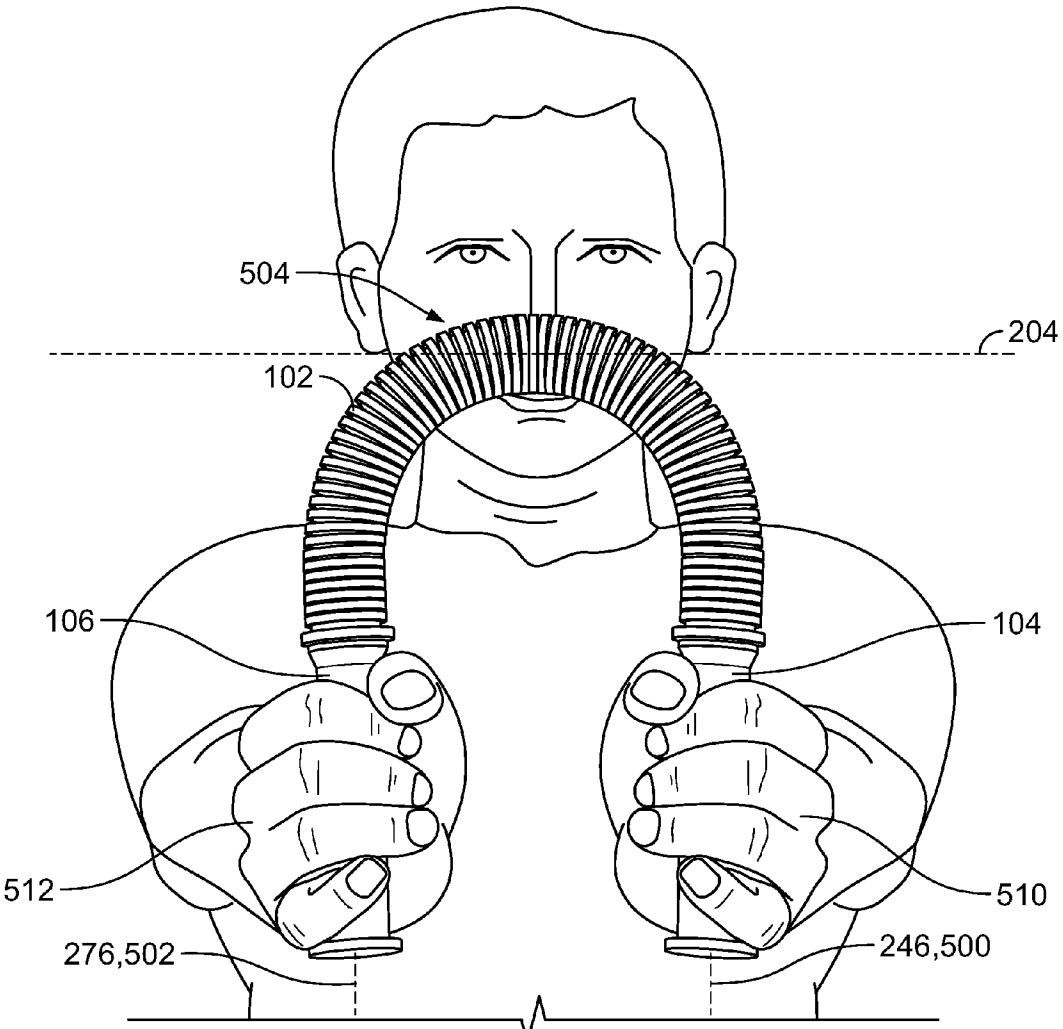
FIG. 5 is an illustration of an example training device in a flexed position.

The second end wall 212 may extend radially from an end of the housing wall 206 towards a center of the housing portion 102. In an example, the second end wall 212 may extend circumferentially around the second end 202 of the housing wall 206 to define a second end opening 216. The second end opening 216 may be in communication with the internal bore 208, such that one or more structures may pass between the internal bore and an exterior through the second end opening 216. In an example, the second end wall 212 may extend along a plane that is substantially perpendicular to the axis 204 and to the housing wall 206. The second end wall 212 and the first end wall 210 may extend substantially parallel to each other at opposing ends of the housing portion 102. In an example, the housing portion 102 (e.g., the housing wall 206) may comprise a flexible, non-rigid material, such that the housing portion 102 may be moved between an unflexed position (e.g., as illustrated in FIGS. 1 and 2A), in which the housing portion 102 extends along the axis 204, and a flexed position (e.g., as illustrated in FIG. 5), in which the housing portion 102 extends non-linearly.

The exercise training device 100 comprises a biasing device 220. The biasing device 220 may be disposed within the internal bore 208 of the housing portion 102. In an example, the biasing device 220 and the housing portion 102 may extend co-axially along the axis 204. The biasing device 220 may have a cross-sectional size (e.g., diameter) that is less than a cross-sectional size of an inner surface of the housing portion 102. As such, the biasing device 220 may be received within the internal bore 208 of the housing portion 102.

The biasing device 220 may comprise a spring, for example, that is movable between a flexed position and an unflexed position. In the unflexed position, the biasing device 220 may extend linearly along the axis 204. In the flexed position, the biasing device 220 may extend non-linearly. At rest, the biasing device 220 may remain in the unflexed position. However, in response to an application of a sufficient amount of force, which depends on the spring's constant, the biasing device 220 may be moved from the unflexed position to the flexed position. In the absence of a force, the biasing device 220 may revert back to the unflexed position, wherein the biasing device 220 may remain until a force is applied. The amount of force needed to move the biasing device 220 between the unflexed position and the flexed position may be chosen based on a spring constant of the biasing device 220, dimensions of the biasing device 220 (e.g., length, cross-sectional size, etc.), etc.

The biasing device 220 may extend between a first biasing end 222 and a second biasing end 224. In an example, the biasing device 220 may comprise one or more coils 226. The biasing device 220, which may comprise a spring, may define a substantially hollow second internal bore 228. The biasing device 220 is not limited to comprising the illustrated coils 226. Rather, in an example, the biasing device 220 may comprise a flexible wall that allows for movement of the biasing device 220 between the flexed position and the unflexed position. In such an example, the flexible wall may define the second internal bore 228. The second internal bore 228 may have a second internal bore cross-sectional size 231.

In an example, the biasing device 220 may have a substantially matching shape as the housing portion 102, such as by having a circular cross-sectional shape. However, in other examples, other shapes are envisioned (e.g., oval shape, quadrilateral shape, etc.). The biasing device 220 may define a first end opening 230 at the first biasing end 222 and a second end opening 232 at the second biasing end 224. The first end opening 230 may be in communication with the second internal bore 228, such that one or more structures may pass between the second internal bore 228 and an exterior through the first end opening 230. In an example, the second end opening 232 may be in communication with the second internal bore 228, such that one or more structures may pass between the second internal bore 228 and an exterior through the second end opening 232.

The exercise training device 100 comprises the first gripping portion 104. The first gripping portion 104 may be received at least partially within the internal bore 208 and/or the second internal bore 228. In an example, the first gripping portion 104 may be attached to the first biasing end 222 of the biasing device 220. In an example, the first gripping portion 104 may be received within the internal bore 208 through the first end 200 of the housing portion 102.

The first gripping portion 104 may extend between a first gripping end 242 and a second gripping end 244. In an example, the first gripping portion 104 may extend along a first gripping axis 246. In an example, when the housing portion 102 and the biasing device 220 are in the unflexed position, the housing portion 102, the biasing device 220, and the first gripping portion 104 may extend substantially co-axially along a common axis. In an example, the first gripping portion 104 may comprise a substantially rigid, inflexible material that is resistant to bending or flexing, such that the first gripping portion 104 may extend along the first gripping axis 246 regardless of whether the housing portion 102 and the biasing device 220 are in the flexed position or unflexed position.

The first gripping portion 104 comprises a first attachment part 250 located at the second gripping end 244. The first attachment part 250 may be received within the internal bore 208 through the first end 200 of the housing portion 102, and within the second internal bore 228 through the first biasing end 222 of the biasing device 220.

The first attachment part 250 may be attached to the first biasing end 222 of the biasing device 220. For example, the first attachment part 250 may comprise a first outer surface 252 that has one or more grooves 254 that extend circumferentially around the first outer surface 252 of the first attachment part 250. The grooves 254 may comprise indentations, channels, depressions, etc. that are formed within the first outer surface 252. In an example, the grooves 254 may substantially match a shape of the coils 226 of the biasing device 220, such that the coils 226 may be received at least partially within the grooves 254. For example, a pitch length that separates two adjacent coils 226A and 226B may substantially match a pitch length that separates two adjacent grooves 254A and 254B. Likewise, a cross-sectional size of the coils 226 may substantially match a cross-sectional size of the grooves 254. As such, the grooves 254 may receive the coils 226 therein, such that the biasing device 220 and the first outer surface 252 may threadingly engage. In this way, the first outer surface 252 may receive a portion of the biasing device 220 within the grooves 254. The biasing device 220 and the first outer surface 252 may therefore threadingly engage when the grooves 254 receive the portion of the biasing device 220.

In an example, the first attachment part 250 may have a substantially matching shape as an inner surface of the biasing device 220, such as by having a circular cross-sectional shape (though, in other examples, other shapes are envisioned such as an oval shape, quadrilateral shape, etc.). Due to having the circular cross-sectional shape, the first attachment part 250 may be rotated with respect to the biasing device 220, to cause the threading engagement and insertion of the first attachment part 250 into the second internal bore 228.

In an example, the first attachment part 250 may have a first cross-sectional size 258 that is less than the second internal bore cross-sectional size 231 of the second internal bore 228. The first cross-sectional size 258 may be less than a cross-sectional size of the first end opening 214 of the first end wall 210. As such, the first attachment part 250 may not contact the first end wall 210 of the housing portion 102 when the first attachment part 250 is attached to the first biasing end 222 of the biasing device 220. In an example, rotation of the first gripping portion 104 about the first gripping axis 246 in a first direction may cause the first attachment part 250 to be inserted into the second internal bore 228 of the biasing device 220. Conversely, rotation of the first gripping portion 104 about the first gripping axis 246 in a second direction that is opposite the first direction may cause the first attachment part 250 to be removed from the second internal bore 228 of the biasing device 220. In this way, the first gripping portion 104 may be selectively attached to and removed from the biasing device 220 and the housing portion 102.

The first gripping portion 104 comprises a first gripping part 260 located at the first gripping end 242. The first gripping part 260 may not be received within the internal bore 208 through the first end 200 of the housing portion 102 or within the second internal bore 228 through the first biasing end 222 of the biasing device 220. In an example, the first gripping part 260 is attached to the first attachment part 250, with the first gripping part 260 extending at an exterior of the internal bore 208.

The first gripping part 260 may have a first gripping surface 261 located on an outer radial side of the first gripping part 260. The first gripping surface 261 may comprise a material having an increased frictional resistance, such as rubber or other elasatomeric materials. In this way, a user may grip the first gripping surface 261, with inadvertent slipping between the user's hand and the first gripping surface 261 reduced. In an example, the first gripping surface 261 may comprise a first sleeve 263 or other structure that may receive the first gripping part 260 within an opening defined within the first gripping surface 261. The first sleeve 263 may comprise a different material than the first attachment part 250. In an example, the first gripping part 260 may have a second cross-sectional size 262 that is equal to the first cross-sectional size 258 of the first attachment part 250.

The first gripping portion 104 comprises a first intermediate part 264 that may be disposed between the first attachment part 250 and the first gripping part 260. The first intermediate part 264 may comprise a wall that extends substantially parallel to the first end wall 210 of the housing portion 102. In an example, the first intermediate part 264 may attach the first attachment part 250 and the first gripping part 260. The first intermediate part 264 may have a third cross-sectional size 266 that is greater than the first cross-sectional size 258 and the second cross-sectional size 262. In an example, the third cross-sectional size 266 may be greater than a first opening cross-sectional size 268 of the first end opening 214 at the first end 200 of the housing portion 102.

In this way, the first intermediate part 264 may abut the first end wall 210 of the housing portion 102 when the first attachment part 250 is received within the housing portion 102. The first intermediate part 264 may contact the first end wall 210, to limit the first gripping portion 104 from being inserted into the housing portion 102 past a certain point. As such, the first intermediate part 264 may maintain the relative positions of the first attachment part 250 within the housing portion 102 and the first gripping part 260 at an exterior of the housing portion 102.

The exercise training device 100 comprises the second gripping portion 106. The second gripping portion 106 may be received at least partially within the internal bore 208 and/or the second internal bore 228. In an example, the second gripping portion 106 may be attached to the second biasing end 224 of the biasing device 220. In an example, the second gripping portion 106 may be received within the internal bore 208 through the second end 202 of the housing portion 102.

The second gripping portion 106 may extend between a first gripping end 272 and a second gripping end 274. In an example, the second gripping portion 106 may extend along a second gripping axis 276. In an example, when the housing portion 102 and the biasing device 220 are in the unflexed position, the housing portion 102, the biasing device 220, the first gripping portion 104, and the second gripping portion 106 may extend substantially co-axially along a common axis. In an example, the second gripping portion 106 may comprise a substantially rigid, inflexible material that is resistant to bending or flexing, such that the second gripping portion 106 may extend along the second gripping axis 276 regardless of whether the housing portion 102 and the biasing device 220 are in the flexed position or unflexed position.

The second gripping portion 106 comprises a second attachment part 280 located at the second gripping end 274. The second attachment part 280 may be received within the internal bore 208 through the second end 202 of the housing portion 102, and within the second internal bore 228 through the second biasing end 224 of the biasing device 220.

The second attachment part 280 may be attached to the second biasing end 224 of the biasing device 220. For example, the second attachment part 280 may comprise a second outer surface 282 that has one or more grooves 284 that extend circumferentially around the second outer surface 282 of the second attachment part 280. The grooves 284 may comprise indentations, channels, depressions, etc. that are formed within the second outer surface 282. In an example, the grooves 284 may substantially match a shape of the coils 226 of the biasing device 220, such that the coils 226 may be received at least partially within the grooves 284. For example, a pitch length that separates two adjacent coils 226C and 226D may substantially match a pitch length that separates two adjacent grooves 284A and 284B. Likewise, a cross-sectional size of the coils 226 may substantially match a cross-sectional size of the grooves 284. As such, the grooves 284 may receive the coils 226 therein, such that the biasing device 220 and the second outer surface 282 may threadingly engage. In this way, the second outer surface 282 may receive a portion of the biasing device 220 within the grooves 284. The biasing device 220 and the second outer surface 282 may therefore threadingly engage when the grooves 284 receive the portion of the biasing device 220.

In an example, the second attachment part 280 may have a substantially matching shape as an inner surface of the biasing device 220, such as by having a circular cross-sectional shape (though, in other examples, other shapes are envisioned such as an oval shape, quadrilateral shape, etc.). Due to having the circular cross-sectional shape, the second attachment part 280 may be rotated with respect to the biasing device 220, to cause the threading engagement and insertion of the second attachment part 280 into the second internal bore 228.

In an example, the second attachment part 280 may have a first cross-sectional size 288 that is less than the second internal bore cross-sectional size 231 of the second internal bore 228. The first cross-sectional size 288 may be less than a cross-sectional size of the second end opening 216 of the second end wall 212. As such, the second attachment part 280 may not contact the second end wall 212 of the housing portion 102 when the second attachment part 280 is attached to the second biasing end 224 of the biasing device 220. In an example, rotation of the first gripping portion 104 about the second gripping axis 276 in a first direction may cause the second attachment part 280 to be inserted into the second internal bore 228 of the biasing device 220. Conversely, rotation of the first gripping portion 104 about the second gripping axis 276 in a second direction that is opposite the first direction may cause the second attachment part 280 to be removed from the second internal bore 228 of the biasing device 220. In this way, the second gripping portion 106 may be selectively attached to and removed from the biasing device 220 and the housing portion 102.

The second gripping portion 106 comprises a second gripping part 290 located at the first gripping end 272. The second gripping part 290 may not be received within the internal bore 208 through the second end 202 of the housing portion 102 or within the second internal bore 228 through the second biasing end 224 of the biasing device 220. In an example, the second gripping part 290 is attached to the second attachment part 280, with the second gripping part 290 extending at an exterior of the internal bore 208.

The second gripping part 290 may have a second gripping surface 291 located on an outer radial side of the second gripping part 290. The second gripping surface 291 may comprise a material having an increased frictional resistance, such as rubber or other elasatomeric materials. In this way, a user may grip the second gripping surface 291, with inadvertent slipping between the user's hand and the second gripping surface 291 reduced. In an example, the second gripping surface 291 may comprise a second sleeve 293 or other structure that may receive the second gripping part 290 within an opening defined within the second gripping surface 291. The second gripping surface 291 may comprise a different material than the second attachment part 280. In an example, the second gripping part 290 may have a second cross-sectional size 292 that is equal to the first cross-sectional size 288 of the second attachment part 280.

The second gripping portion 106 comprises a second intermediate part 294 that may be disposed between the second attachment part 280 and the second gripping part 290. The second intermediate part 294 may comprise a wall that extends substantially parallel to the second end wall 212 of the housing portion 102. In an example, the second intermediate part 294 may attach the second attachment part 280 and the second gripping part 290. The second intermediate part 294 may have a third cross-sectional size 296 that is greater than the first cross-sectional size 288 and the second cross-sectional size 292. In an example, the third cross-sectional size 296 may be greater than a second opening cross-sectional size 298 of the second end opening 216 at the second end 202 of the housing portion 102. In an example, the first opening cross-sectional size 268 of the first end opening 214 may be substantially similar to or identical to the second opening cross-sectional size 298 of the second end opening 216, wherein the first opening cross-sectional size 268 and/or the second opening cross-sectional size 298 are less than a cross-sectional size of the internal bore 208.

In this way, the second intermediate part 294 may abut the second end wall 212 of the housing portion 102 when the second attachment part 280 is received within the housing portion 102. The second intermediate part 294 may contact the second end wall 212, to limit the second gripping portion 106 from being inserted into the housing portion 102 past a certain point. As such, the second intermediate part 294 may maintain the relative positions of the second attachment part 280 within the housing portion 102 and the second gripping part 290 at an exterior of the housing portion 102.

It will be appreciated that the first gripping portion 104 and the second gripping portion 106 are not limited to being attached to the first biasing end 222 and the second biasing end 224 of the biasing device 220. For example, in addition or in the alternative, the first gripping portion 104 may be attached to the first end 200 of the housing portion 102. The second gripping portion 106 may be attached to the second end 202 of the housing portion 102. In such an example, the first gripping portion 104 may threadingly engage the first end wall 210 of the housing portion 102, while the second gripping portion 106 may threadingly engage the second end wall 212 of the housing portion 102. In such an example, the first end wall 210 and the second end wall 212 may be received within the grooves 254, 284 of the first gripping portion 104 and the second gripping portion 106.

The first gripping portion 104 and the second gripping portion 106 may be attached to the first end wall 210 and the second end wall 212 in any number of ways, including, but not limited to, the threading engagement described herein. In an example, the first gripping portion 104 and the second gripping portion 106 may be attached by mechanical fasteners to the housing portion 102, such as screws, bolts, etc. In addition or in the alternative to the previous examples, the first gripping portion 104 and the second gripping portion 106 may be attached by an adhesive to the housing portion 102. Indeed, the first gripping portion 104 and the second gripping portion 106 may be attached in any number of ways to the housing portion 102 and/or to the biasing device 220, some of which may comprise mechanical fasteners, adhesives, mechanical locking means, etc.

In an example, to further attach the first gripping portion 104 and the second gripping portion 106 to the housing portion 102 and to the biasing device 220, the first gripping portion 104 and the second gripping portion 106 may be attached to each other. For example, a fastener (e.g., a rope, a chain, a wire, a cable, etc.) may extend between the first gripping end 242 of the first gripping portion 104 and the first gripping end 272 of the second gripping portion 106. The fastener may extend through the internal bore 208 and the second internal bore 228 to maintain the first gripping portion 104 and the second gripping portion 106 in a taut, fixed engagement with each other and with the housing portion 102 and the biasing device 220. In such an example, the fastener may be tightened between the first gripping portion 104 and the second gripping portion 106 such that a distance between the first gripping portion 104 and the second gripping portion 106 may be maintained.

Figure 3:
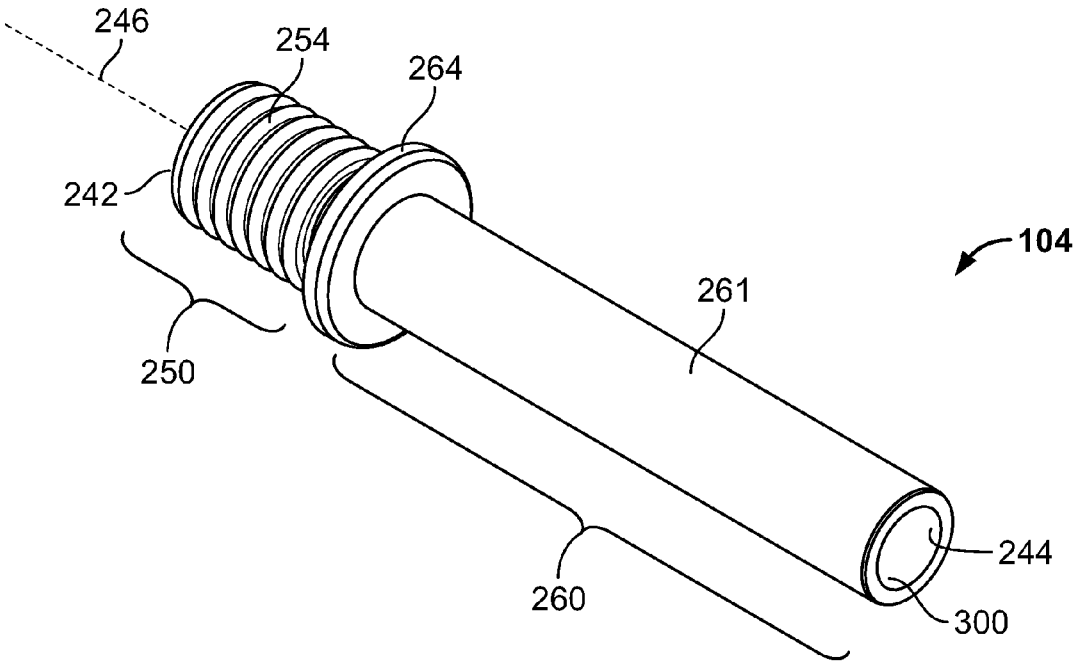
FIG. 3 is an illustration of a portion of an example training device.

Referring to FIG. 3, the first gripping portion 104 is illustrated separate from the housing portion 102. In an example, the grooves 254 at the first outer surface 252 may function as an external male thread that is inserted into the second internal bore 228 of the biasing device 220. Rotation of the first gripping portion 104 in a first direction may cause the first attachment part 250 to be inserted into the second internal bore 228, with the coils 226 received within the grooves 254. The first gripping portion 104 may be rotated in the first direction until the first intermediate part 264 contacts and/or abuts the first end wall 210 of the housing portion 102. This contact between the first intermediate part 264 and the first end wall 210 may limit further insertion of the first gripping portion 104 into the housing portion 102. The first gripping portion 104 may be removed from the housing portion 102 by rotating the first gripping portion 104 in the second direction.

The first gripping portion 104 is illustrated without the first sleeve 263 illustrated in FIGS. 2A and 2B. The first sleeve 263 may be attachable to and/or removable from the first gripping part 260. In an example, the first gripping part 260 may comprise one or more features that increase friction of the first gripping surface 261 that the user grips or holds. For example, the first gripping part 260 may have features such as one or more indentations, scores (e.g., cuts), elastomeric portions, etc. In an example, the first gripping portion 104 defines a first channel 300 extending axially through the first attachment part 250, the first gripping part 260, and the first intermediate part 264. The first channel 300 may function to reduce the weight of the first gripping portion 104.

Figure 4:
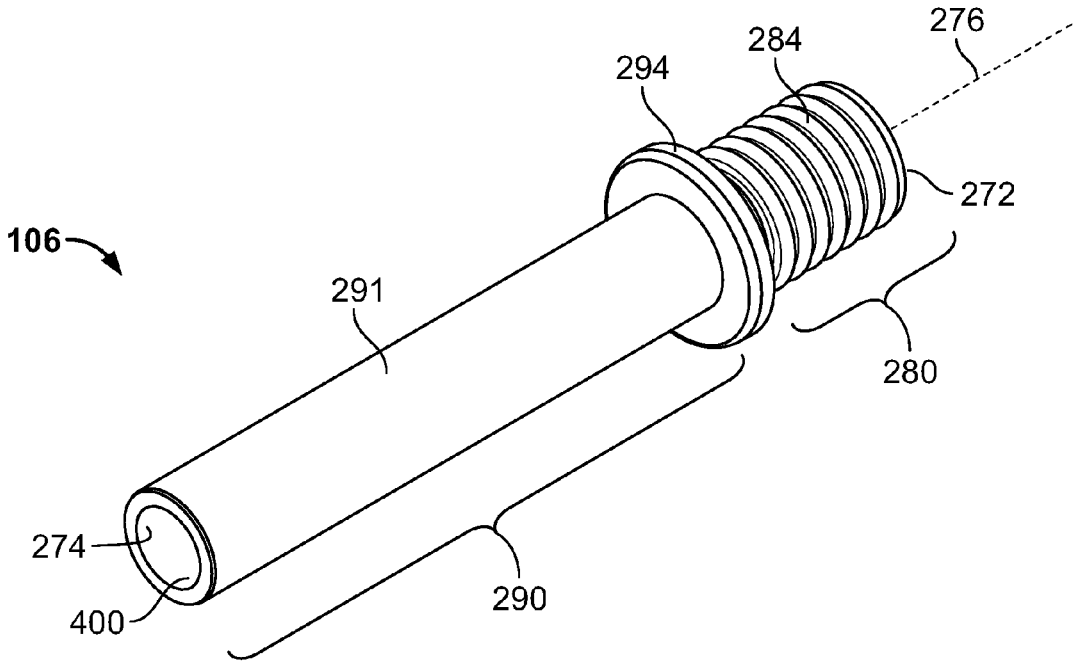
FIG. 4 is an illustration of a portion of an example training device.

Referring to FIG. 4, the second gripping portion 106 is illustrated separate from the housing portion 102. In an example, the grooves 284 at the second outer surface 282 may function as an external male thread that is inserted into the second internal bore 228 of the biasing device 220. Rotation of the second gripping portion 106 in a first direction may cause the second attachment part 280 to be inserted into the second internal bore 228, with the coils 226 received within the grooves 284. The second gripping portion 106 may be rotated in the first direction until the second intermediate part 294 contacts and/or abuts the second end wall 212 of the housing portion 102. This contact between the second intermediate part 294 and the second end wall 212 may limit further insertion of the second gripping portion 106 into the housing portion 102. The second gripping portion 106 may be removed from the housing portion 102 by rotating the second gripping portion 106 in the second direction.

The second gripping portion 106 is illustrated without the second sleeve 293 that is illustrated in FIGS. 2A and 2B. The second sleeve 293 may be attachable to and/or removable from the second gripping part 290. In an example, the second gripping part 290 may comprise one or more features that increase friction of the second gripping surface 291 that the user grips or holds. For example, the second gripping part 290 may have features such as one or more indentations, scores (e.g., cuts), elastomeric portions, etc. In an example, the second gripping part 290 defines a second channel 400 extending axially through the second attachment part 280, the second gripping part 290, and the second intermediate part 294. The second channel 400 may function to reduce the weight of the second gripping portion 106.

Referring to FIG. 5, the exercise training device 100 may be moved between the unflexed position (e.g., illustrated in FIGS. 1 and 2A) and a flexed position (e.g., illustrated in FIG. 5). Initially, a user may grip the exercise training device 100 when the exercise training device 100 is in the unflexed position. For example, the first gripping portion 104 may be gripped by one hand 510 of the user while the second gripping portion 106 may be gripped by the other hand 512 of the user. In the unflexed position (e.g., illustrated in FIG. 2A), the housing portion 102, the biasing device 220, the first gripping portion 104, and the second gripping portion 106 may extend co-axially along the axis 204.

With the user gripping the first gripping portion 104 and the second gripping portion 106, the user may apply a pressure (e.g., a first pressure 110 and a second pressure 112 illustrated in FIGS. 1 and 2A) to the unflexed exercise training device 100. The first pressure 110 and the second pressure 112 may be applied in a direction that is non-parallel to the axis 204. For example, in response to a pressure 110, 112 applied by the first gripping portion 104 and the second gripping portion 106 along a direction that is transverse to the axis 204, the biasing device 220 and the housing portion 102 may move from the unflexed position (e.g., illustrated in FIG. 1), in which the biasing device 220 and the housing portion 102 extend along the axis 204, to the flexed position (e.g., illustrated in FIG. 5), in which the biasing device 220 and the housing portion 102 extend along a non-linear axis.

The ease with which the exercise training device 100 moves between the unflexed position and the flexed position may depend, at least in part, on the stiffness of the biasing device 220. For example, if the biasing device 220 has a relatively low stiffness (e.g., less stiff), then a smaller amount of pressure 110, 112 may be needed to move the exercise training device 100 from the unflexed position to the flexed position. In an example, if the biasing device 220 has a relatively high stiffness (e.g., more stiff), then a higher amount of pressure 110, 112 may be needed to move the exercise training device 100 from the unflexed position to the flexed position. In either of these examples, in the absence of pressure applied to the exercise training device 100 (e.g., when the user does not apply pressure), the exercise training device 100 may revert to and/or remain in the unflexed position. In an example, when the pressure 110, 112 applied by the user is below a certain predetermined threshold, the exercise training device 100 may not move to the fully flexed position of FIG. 5. Rather, the exercise training device 100 may be only partially flexed to a position between the unflexed position illustrated in FIGS. 1 and 2A, and the flexed position illustrated in FIG. 5.

In the flexed position of FIG. 5, the first gripping portion 104 may extend along the first gripping axis 246, while the second gripping portion 106 may extend along the second gripping axis 276. In an example, in the flexed position, the first gripping axis 246 may extend substantially parallel to and non-coaxial with respect to the second gripping axis 276. Likewise, in an example, in the flexed position, the first biasing end 222 of the biasing device 220 may extend along a first biasing end axis 500 while the second biasing end 224 of the biasing device 220 extends along a second biasing end axis 502. The first biasing end axis 500 may be parallel to and non-coaxial with respect to the second biasing end axis 502. In this flexed position, a central portion 504 of the biasing device 220 and the housing portion 102 may extend along the axis 204, with the axis 204 substantially perpendicular to the first biasing end axis 500 and the second biasing end axis 502.

In an example, at least one of the first gripping portion 104 or the second gripping portion 106 may have a tapered and/or other configured end such that the tapered end is inserted into the second internal bore 228 of the biasing device 220. The coils 226 defining the second internal bore 228 can define a corresponding configuration as the tapered end of the first gripping portion 104 and/or the second gripping portion 106. In this way, the first gripping portion 104 and/or the second gripping portion 106 can be frictionally affixed to the biasing device 220 by being inserted into the second internal bore 228 of the biasing device 220. In an example, the tapered end of the first gripping portion 104 and/or the second gripping portion 106 can have a textured surface, such as an elastomeric surface, rubber surface, or the like, to grip the biasing device 220 and thereby decrease the likelihood of inadvertently detaching from the biasing device 220. In addition or in the alternative, in an example, an inner radial surface of the coils 226 may have a textured surface, such as an elastomeric surface, rubber surface, or the like, to grip the first gripping portion 10 and/or the second gripping portion 106, and thereby decrease the likelihood of inadvertently detaching from the biasing device 220.

In an example, the first gripping portion 104 and/or the second gripping portion 106 can be detached and removed from the ends of the biasing device 220. For example, the first gripping portion 104 and/or the second gripping portion 106 can be removed and replaced with a gripping portion or second gripping portion having one or more different features (e.g., length, cross-sectional size, etc.). The different gripping portions can affect the difficulty in moving the exercise training device 100 between the unflexed position and the unflexed position (e.g., longer gripping portion versus shorter gripping portion, etc.). In addition, due to the removability of the first gripping portion 104 and/or the second gripping portion 106 from the biasing device 220, the biasing device 220 can be replaced with a different biasing device having a different spring constant. Different biasing devices may require a different degree of force to move the exercise training device 100 between the unflexed position and the unflexed position.

In an example, at least one of the first gripping portion 104 the second gripping portion 106 may have a telescoping configuration (e.g., a concentric arrangement of two or more subparts that may threadingly, frictionally, etc. selectively attach to one another). For example, one or both of the first gripping portion 104 or the second gripping portion 106 may comprise a plurality of parts, such as a first part and a second part. In an example, the first part may be attached to an end of the biasing device 220, while the second part may be movably adjustable with respect to the first part. A user may grip the second part and, if desired, may adjust an axial position of the second part with respect to the first part.

This telescoping configuration may be provided to establish a gripping portion 104, 106 having adjustable lengths, where a degree of difficulty of bending the biasing device may be a function of a distance of a user's hands from the biasing device 220. For example, when the first gripping portion 104 and/or the second gripping portion 106 are in a fully extended position, a force required to move the biasing device 220 between the unflexed position and the flexed position may be different than if the first gripping portion 104 and/or the second gripping portion 106 are in a non-extended (e.g., retracted/shortened) position. As such, a same biasing device 220 may be used for varying degrees of resistance and/or other training.

It will be appreciated that while the figures illustrate possible dimensions/sizes of the exercise training device 100, these dimensions are merely exemplary and not intended to be limiting. The example dimensions merely illustrate possible dimensions/sizes of the exercise training device. In these examples, the exercise training device may have a range of dimensions. For example, a range of lengths are envisioned for the exercise training device 100, such as between 5 inches and 40 inches, or the like.

The foregoing outlines features of several embodiments so that those of ordinary skill in the art may better understand various aspects of the present disclosure. Those of ordinary skill in the art should appreciate that they may readily use the present disclosure as a basis for designing or modifying other processes and structures for carrying out the same purposes and/or achieving the same advantages of various embodiments introduced herein. Those of ordinary skill in the art should also realize that such equivalent constructions do not depart from the spirit and scope of the present disclosure, and that they may make various changes, substitutions, and alterations herein without departing from the spirit and scope of the present disclosure.

Although the subject matter has been described in language specific to structural features or methodological acts, it is to be understood that the subject matter of the appended claims is not necessarily limited to the specific features or acts described above. Rather, the specific features and acts described above are disclosed as example forms of implementing at least some of the claims.

Various operations of embodiments are provided herein. The order in which some or all of the operations are described should not be construed to imply that these operations are necessarily order dependent. Alternative ordering will be appreciated having the benefit of this description. Further, it will be understood that not all operations are necessarily present in each embodiment provided herein. Also, it will be understood that not all operations are necessary in some embodiments.

It will be appreciated that layers, features, elements, etc. depicted herein are illustrated with particular dimensions relative to one another, such as structural dimensions or orientations, for example, for purposes of simplicity and ease of understanding and that actual dimensions of the same differ substantially from that illustrated herein, in some embodiments.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application and the appended claims are generally be construed to mean "one or more" unless specified otherwise or clear from context to be directed to a singular form. Also, at least one of A and B and/or the like generally means A or B or both A and B. Furthermore, to the extent that "includes", "having", "has", "with", or variants thereof are used, such terms are intended to be inclusive in a manner similar to the term "comprising". Also, unless specified otherwise, "first," "second," or the like are not intended to imply a temporal aspect, a spatial aspect, an ordering, etc. Rather, such terms are merely used as identifiers, names, etc. for features, elements, items, etc. For example, a first element and a second element generally correspond to element A and element B or two different or two identical elements or the same element.

Also, although the disclosure has been shown and described with respect to one or more implementations, equivalent alterations and modifications will occur to others of ordinary skill in the art based upon a reading and understanding of this specification and the annexed drawings. The disclosure comprises all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. An exercise training device comprising:

a housing portion extending between a first end and a second end along an axis, the housing portion having a housing wall defining an internal bore;

a biasing device disposed within the internal bore of the housing portion, the biasing device and the housing portion extending co-axially;

a first gripping portion received within the internal bore through the first end of the housing portion, the first gripping portion attached to a first biasing end of the biasing device, the first gripping portion configured to be gripped by a user, the first gripping portion comprising:

a first attachment part received within the internal bore through the first end of the housing portion, the first attachment part attached to the first biasing end of the biasing device;

a first gripping part attached to the first attachment part and extending at an exterior of the internal bore, the first gripping part having a gripping surface that is configured to be gripped by the user, wherein the first attachment part has a first cross-sectional size that is equal to a second cross-sectional size of the first gripping part; and a first intermediate part disposed between the first attachment part and the first gripping part, the first intermediate part attaching the first attachment part and the first gripping part, the first intermediate part having a third cross-sectional size that is greater than the first cross-sectional size and the second cross-sectional size; and a second gripping portion received within the internal bore through the second end of the housing portion, the second gripping portion attached to a second biasing end of the biasing device, the second gripping portion configured to be gripped by the user, wherein, in response to a pressure applied by the first gripping portion and the second gripping portion along a direction that is non-parallel to the axis, the biasing device and the housing portion are configured to move from an unflexed position, in which the biasing device and the housing portion extend along the axis, to a flexed position, in which the biasing device and the housing portion extend along a non-linear axis.

2. The exercise training device of claim 1, the third cross-sectional size being greater than a first opening cross-sectional size of a first end opening at the first end of the housing portion.

3. The exercise training device of claim 1, the biasing device having a biasing spring defining a second internal bore.

4. The exercise training device of claim 3, wherein the first attachment part has a first cross-sectional size that is less than a second internal bore cross-sectional size of the second internal bore.

5. The exercise training device of claim 4, wherein the first attachment part comprises an outer surface defining at least one groove, the outer surface configured to receive a portion of the biasing device within the at least one groove.

6. The exercise training device of claim 5, wherein the biasing device and the outer surface are configured to threadingly engage when the at least one groove receives the portion of the biasing device.

7. The exercise training device of claim 1, comprising a first sleeve attachable to the first gripping part.

8. The exercise training device of claim 7, wherein the first sleeve comprises a different material than the first attachment part.

9. The exercise training device of claim 1, the housing portion comprising a first end wall disposed at the first end of the housing wall, the first end wall extending radially from the first end of the housing wall toward a center of the housing portion.

10. The exercise training device of claim 1, wherein the biasing device comprises coils, and a pitch length between adjacent coils of the biasing device is equal to a pitch length between two grooves defined by an outer surface of the first attachment part.

11. An exercise training device comprising:

a housing portion extending between a first end and a second end along an axis, the housing portion having a housing wall defining an internal bore;

a biasing device disposed within the internal bore of the housing portion, the biasing device and the housing portion extending co-axially, the biasing device having a biasing spring defining a second internal bore;

a first gripping portion comprising:

a first attachment part received within the second internal bore through the first end of the housing portion and a first biasing end of the biasing device, the first attachment part engaging the first biasing end to attach the first gripping portion to the biasing device;

a first gripping part attached to the first attachment part and extending at an exterior of the internal bore and the second internal bore, the first gripping part having a gripping surface that is configured to be gripped by a user, wherein the first attachment part has a first cross-sectional size that is equal to a second cross-sectional size of the first gripping part; and a first intermediate part disposed between the first attachment part and the first gripping part, the first intermediate part attaching the first attachment part and the first gripping part, the first intermediate part having a third cross-sectional size that is greater than the first cross-sectional size and the second cross-sectional size; and a second gripping portion comprising:

a second attachment part received within the second internal bore through the second end of the housing portion and a second biasing end of the biasing device, the second attachment part engaging the second biasing end to attach the second gripping portion to the biasing device; and a second gripping part attached to the second attachment part and extending at an exterior of the internal bore and the second internal bore, the second gripping part having a second gripping surface that is configured to be gripped by the user, wherein, in response to a pressure applied by the first gripping portion and the second gripping portion along a direction that is non-parallel to the axis, the biasing device and the housing portion are configured to move from an unflexed position, in which the biasing device and the housing portion extend along the axis, to a flexed position, in which the biasing device and the housing portion extend along a non-linear axis.

12. The exercise training device of claim 11, the third cross-sectional size being greater than a first opening cross-sectional size of a first end opening at the first end of the housing portion.

13. The exercise training device of claim 11, wherein the first attachment part comprises an outer surface defining at least one groove, the outer surface configured to receive a portion of the biasing device within the at least one groove.

14. The exercise training device of claim 13, wherein the biasing device and the outer surface are configured to threadingly engage when the at least one groove receives the portion of the biasing device.

15. The exercise training device of claim 11, comprising a first sleeve attachable to the first gripping part.

16. The exercise training device of claim 15, wherein the first sleeve comprises a different material than the first attachment part.

17. The exercise training device of claim 11, the housing portion comprising a first end wall disposed at the first end of the housing wall, the first end wall extending radially from the first end of the housing wall toward a center of the housing portion.

18. The exercise training device of claim 11, wherein the biasing spring comprises coils, and a pitch length between adjacent coils of the biasing spring is equal to a pitch length between two grooves defined by an outer surface of the first attachment part.

* * * * *